US007629956B2

(12) United States Patent
Jang et al.

(10) Patent No.: US 7,629,956 B2
(45) Date of Patent: Dec. 8, 2009

(54) APPARATUS AND METHOD FOR DRIVING IMAGE DISPLAY DEVICE

(75) Inventors: Chul Sang Jang, Anyang-si (KR); Jong Hoon Kim, Gunpo-si (KR)

(73) Assignee: LG. Display Co., Ltd., Seoul (KR)

( * ) Notice: Subject to any disclaimer, the term of this patent is extended or adjusted under 35 U.S.C. 154(b) by 720 days.

(21) Appl. No.: 11/301,948

(22) Filed: Dec. 13, 2005

(65) Prior Publication Data

US 2006/0284816 A1 Dec. 21, 2006

(30) Foreign Application Priority Data

Jun. 21, 2005 (KR) ..... 10-2005-0053524

(51) Int. Cl.
*G09G 3/36* (2006.01)

(52) U.S. Cl. ..... 345/99; 345/100; 345/212; 345/213; 345/214

(58) Field of Classification Search ..... 345/99–100, 345/212–214
See application file for complete search history.

(56) References Cited

U.S. PATENT DOCUMENTS 6,611,247 B1 * 8/2003 Chang et al. ..... 345/99
2002/0008682 A1 1/2002 Park
2002/0015028 A1 2/2002 Park
2005/0264586 A1 12/2005 Kim

FOREIGN PATENT DOCUMENTS

EP 1 414 013 A2 4/2004
EP 1 414 013 A3 10/2005

* cited by examiner

*Primary Examiner*—Richard Hjerpe
*Assistant Examiner*—Leonid Shapiro
(74) *Attorney, Agent, or Firm*—Brinks Hofer Gilson & Lione

(57) ABSTRACT

An apparatus and method for driving an image display device is disclosed, in which data signals are transmitted in a multi-level to reduce transmission frequencies, power consumption and transmission lines. The apparatus for driving an image display device includes a display panel including an image display unit for displaying images, a plurality of data driver integrated circuits supplying image signals to the image display unit, and a timing controller converting externally supplied i bit digital source data (i is a positive number) to a plurality of voltage levels to supply the converted voltage levels to the respective data driver integrated circuits and controlling the data driver integrated circuits.

9 Claims, 7 Drawing Sheets

APPARATUS AND METHOD FOR DRIVING IMAGE DISPLAY DEVICE

This application claims the benefit of the Korean Patent Application No. P2005-53524, filed on Jun. 21, 2005, which is hereby incorporated by reference as if fully set forth herein.

BACKGROUND OF THE INVENTION

1. Field of the Invention

The present invention relates to a display device, and more particularly, to an apparatus and method for driving an image display device in which data signals are transmitted in a multilevel to reduce transmission frequencies, power consumption and transmission lines.

2. Discussion of the Related Art

Recently, various flat panel displays that can reduce weight and volume of a cathode ray tube have been developed. Examples of the flat panel displays include a liquid crystal display (LCD), a field emission display (FED), a plasma display panel (PDP), and a light emitting display (LED).

Among them, the LCD includes a thin film transistor substrate, a color filter substrate, and a liquid crystal layer. At this time, the thin film transistor substrate includes a plurality of liquid crystal cells arranged in regions defined by a plurality of gate and data lines, and a plurality of thin film transistors serving as switching elements formed in the respective liquid crystal cells. The liquid crystal layer is formed between thin film transistor substrate and the color filter substrate, wherein the thin film transistor substrate is provided at a predetermined interval from the color filter substrate. The LCD displays desired images by forming an electric field in the liquid crystal layer depending on data signals to control.

FIG. 1 illustrates a related art apparatus for driving an LCD.

Referring to FIG. 1, the related art apparatus for driving an LCD includes an liquid crystal 10 including liquid crystal cells defined by first to nth gate lines GL1 to GLn and first to mth data lines DL1 to DLm, a data driver 40 supplying an analog image signal to the data lines DL1 to DLm, a gate driver 50 supplying scan pulses to the gate lines GL1 to GLn, and a timing controller 30 aligning externally input digital source data (RGB) to be suitable for driving of the liquid crystal 10, supplying the aligned digital source data to the data driver 40 and controlling the data driver 40 and the gate driver 50.

The liquid crystal 10 includes a thin film transistor (TFT) formed in a region defined by the gate lines GL1 to GLn and the data lines DL1 to DLm, and the liquid crystal cells connected to the thin film transistor. The thin film transistor supplies data signals from the data lines DL1 to DLm to the liquid crystal cells in response to the scan pulses from the gate lines GL1 to GLn. The liquid crystal cell is comprised of common electrodes facing each other by interposing a liquid crystal there between and sub pixel electrodes connected to the thin film transistor. Therefore, the liquid crystal cells are equivalent to a liquid crystal capacitor Clc. The liquid crystal cell includes a storage capacitor Cst connected to a previous gate line to maintain the data signals filled in the liquid crystal capacitor Clc until the next data signals are filled therein.

The timing controller 30 aligns the externally input digital source data (RGB) to be suitable for driving of the liquid crystal 10 and supplies the aligned digital source data to the data driver 40. Also, the timing controller 30 generates data control signals DCS and gate control signals GCS using a main clock DCLK, a data enable signal DE, and horizontal and vertical signals Hsync and Vsync, which are externally input, so as to control each driving timing of the data driver 40 and the gate driver 50.

The gate driver 50 includes a shift register that sequentially generates scan pulses, i.e., gate high pulses in response to the gate control signal GCS from the timing controller 30. To this end, the gate driver 50 includes a plurality of gate driver integrated circuits having the shift register.

The data driver 40, as shown in FIG. 2, includes a plurality of data driver integrated circuits that supply analog image signals to the respective data lines of the liquid crystal 10.

Each of the data driver integrated circuits 42 converts the data signals aligned from the timing controller 30 to the analog image signals in response to the data control signals DCS supplied from the timing controller 30 and supplies to the data lines DL1 to DLm the analog image signals corresponding to one horizontal line per one horizontal period in which the scan pulses are supplied into the gate lines GL1 to GLn. In other words, each of the data driver integrated circuits 42 generates a plurality of gamma voltages having different voltage values corresponding to the number of gray levels of the data signals and selects one gamma voltage as the analog image signal depending on the gray level values of the data signals to supply the selected signal to the data lines DL1 to DLm.

In the aforementioned related art apparatus for driving an LCD, the timing controller 30 converts the external digital source data (RGB) to TTL/CMOS level depending on a CMOS interface mode and transmits the converted data signals to the data driver 40 in one port-to-one port mode or one port-to-two port mode.

To this end, the related art apparatus for driving an LCD, as shown in FIG. 2, includes a plurality of data transmission lines 22 for data transmission between the timing controller 30 and each data driver integrated circuit 42, and a plurality of control signal transmission lines 24 for transmission of the data control signals DCS.

The timing controller 30 supplies the data signals of the TTL/CMOS level to the data transmission lines 22 and at the same time supplies the data control signals DCS to the control signal transmission lines 24.

Each of the data driver integrated circuits 42 is connected to the data transmission lines 22 and the control signal transmission lines 24 in common. Thus, the respective data driver integrated circuits 42 are sequentially driven depending on the data control signals DCS supplied from the control signal transmission lines 24 to receive the data signals from the data transmission lines 22 and convert the received data signals to the analog image signals to supply the converted signals to the respective data lines.

However, the aforementioned related art apparatus for driving an LCD has several problems. If resolution of the liquid crystal 10 increases, power consumption and electromagnetic interference (EMI) increase due to increase of data transmission lines and driving frequencies. Also, a problem arises in that the increase of the data transmission lines increases the cost of a printed circuit board.

SUMMARY OF THE INVENTION

Accordingly, the present invention is directed to an apparatus and method for driving an image display device, which substantially obviates one or more problems due to limitations and disadvantages of the related art.

An object of the present invention is to provide an apparatus and method for driving an image display device in which data signals are transmitted in a multilevel to reduce transmission frequencies, power consumption and transmission lines.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for driving an image display device according to the present invention includes a display panel including an image display unit for displaying images, a plurality of data driver integrated circuits supplying image signals to the image display unit, and a timing controller converting externally supplied i bit digital source data (i is a positive number) to a plurality of voltage levels to supply the converted voltage levels to the respective data driver integrated circuits and controlling the data driver integrated circuits.

The timing controller compresses the i bit digital source data for the unit of at least 2 bits and converts the compressed data to the plurality of voltage levels to supply the converted voltage levels to the data driver integrated circuits.

The timing controller includes a data compressor compressing the i bit digital source data for the unit of at least 2 bits, and a digital-to-analog converter converting the compressed data from the data compressor to the plurality of voltage levels and supplying them to the data driver integrated circuits.

The digital-to-analog converter converts the compressed data to any one of the first to fourth voltage levels.

The first to third voltage levels are obtained by dividing the fourth voltage level into three parts.

Each of the data driver integrated circuits includes an analog-to-digital converter converting the voltage levels to the digital data for the unit of at least 2 bits, a data restorer restoring the digital data for the unit of at least 2 bits from the analog-to-digital converter to i bit digital data signals, a shift register generating sampling signals, a latch latching the digital data signals from the data restorer depending on the sampling signals, and a digital-to-analog converter converting the digital data signals from the latch to the image signals to supply the converted signals to the display panel.

The timing controller supplies the plurality of voltage levels to the respective data driver integrated circuits.

The timing controller supplies the plurality of voltage levels to the data driver integrated circuits in pairs.

In another aspect of the present invention, a method for driving an image display device including an image display unit for displaying images includes converting externally supplied i bit digital source data (i is a positive number) to a plurality of voltage levels, restoring the voltage levels to i bit digital data to convert them to image signals, and simultaneously supplying scan pulses and the image signals to the image display unit to display the images.

The step of converting the i bit digital source data to the voltage levels includes compressing the i bit digital source data for the unit of at least 2 bits, and converting the compressed data to the plurality of voltage levels.

The step of converting the compressed data to the voltage levels includes converting the compressed data to any one of the first to fourth voltage levels.

The first to third voltage levels are obtained by dividing the fourth voltage level into three parts.

The step of restoring the voltage levels to i bit digital data to convert them to the image signals includes converting the voltage levels to the digital data for the unit of at least 2 bits, restoring the digital data for the unit of at least 2 bits to i bit digital data to generate data signals, generating sampling signals, latching the data signals depending on the sampling signals, and converting the latched data signals to the image signals in a digital-to-analog mode to supply the converted signals to the image display unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
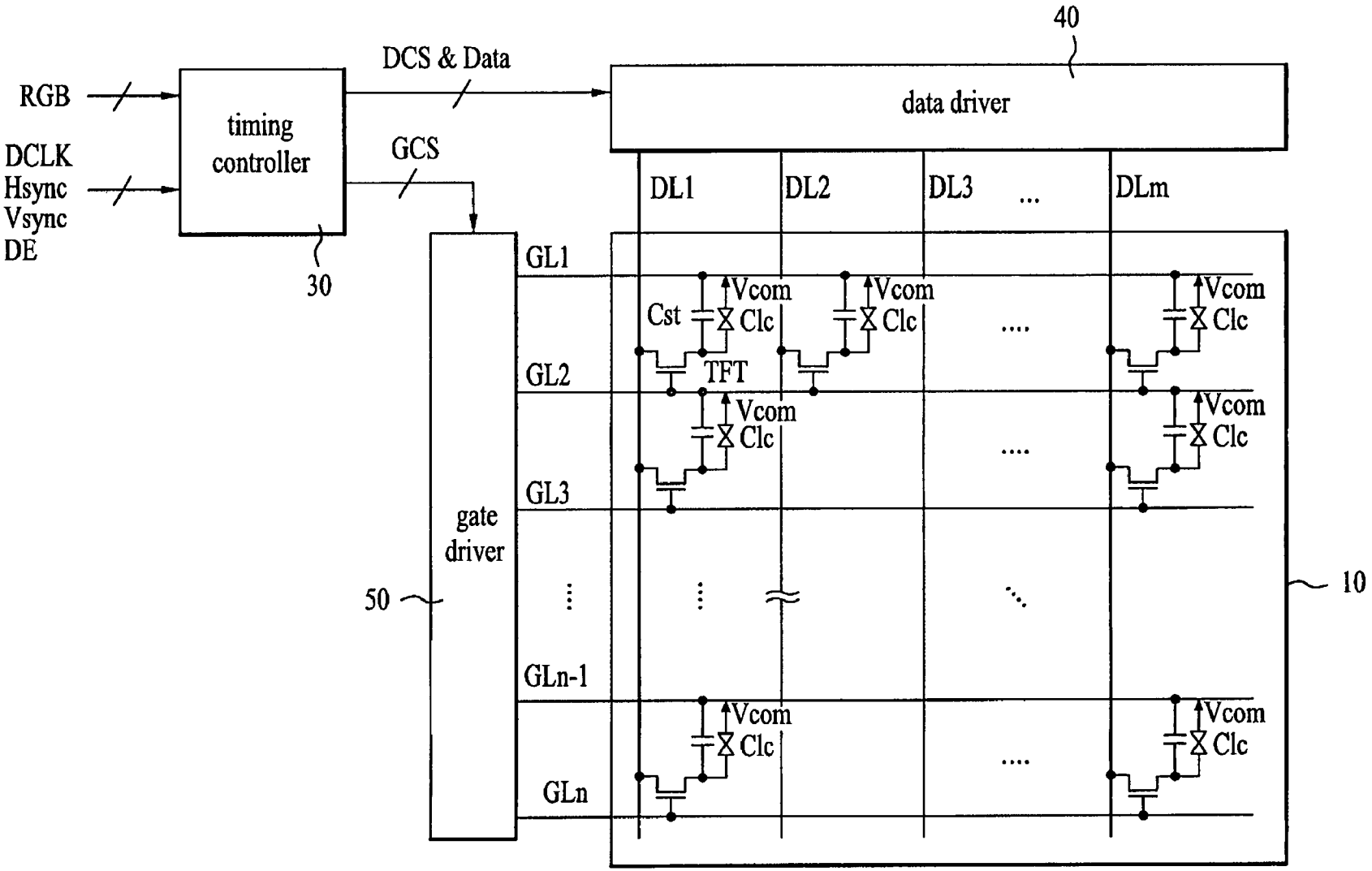
FIG. 1 is a block diagram illustrating a related art apparatus for driving an image display device.
Figure 2:
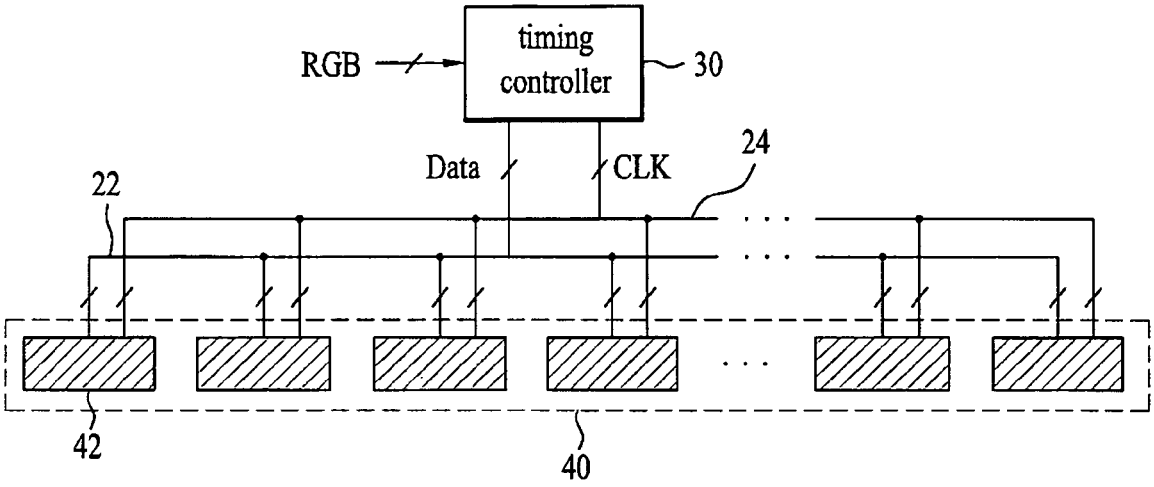
FIG. 2 illustrates a connection structure between a timing controller and a plurality of data driver integrated circuits shown in FIG. 1.
Figure 3:
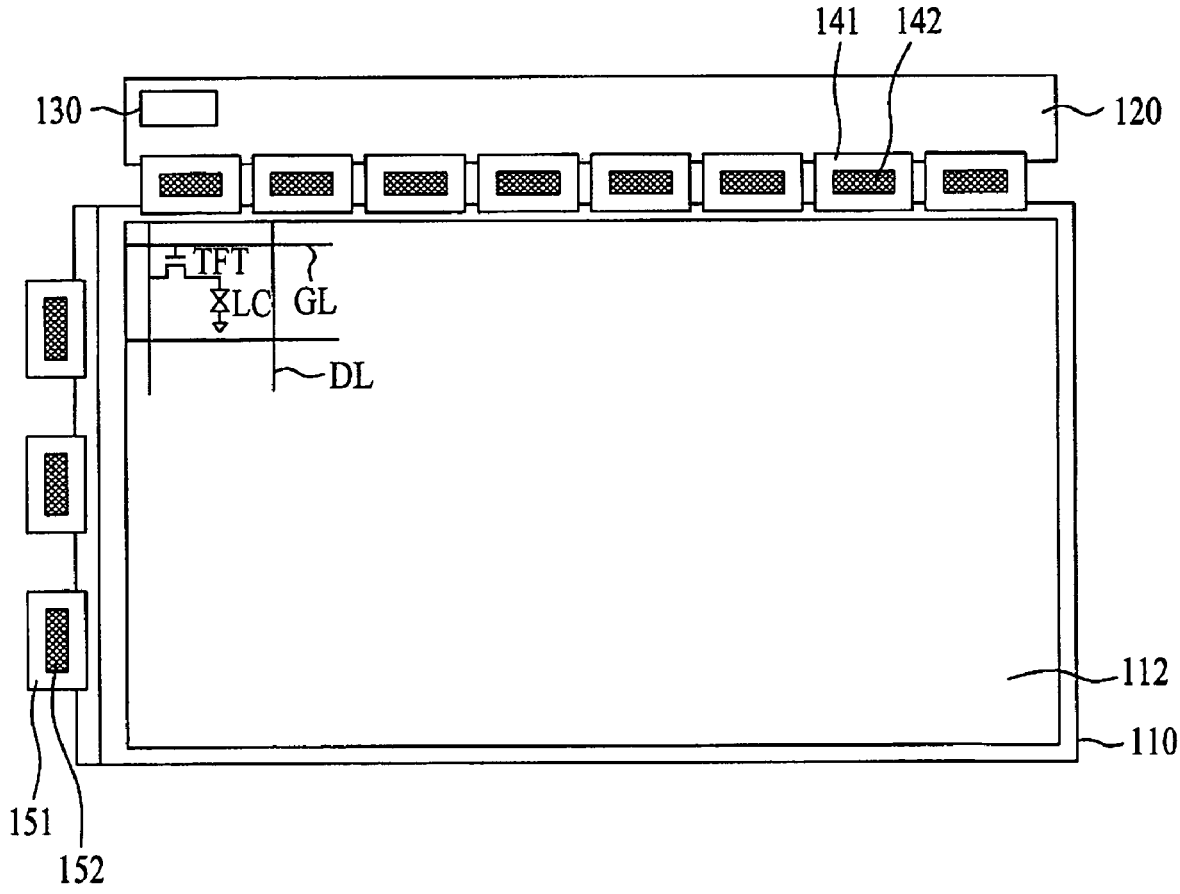
FIG. 3 illustrates an apparatus for driving an image display device according to the embodiment of the present invention.

FIG. 3 illustrates an apparatus for driving an image display device according to the embodiment of the present invention.

Referring to FIG. 3, the apparatus for driving an image display device according to the embodiment of the present invention includes a display panel 110 including an image display unit 112 for displaying images, a plurality of gate driver integrated circuits 152 supplying scan pulses to the image display unit 112, a plurality of data driver integrated circuits 142 supplying analog image signals to the image display unit 112, and a timing controller 130 converting externally supplied i bit digital source data to a plurality of voltage levels to supply the converted voltage levels to the respective data driver integrated circuits 142 and controlling the data driver integrated circuits 142 and the gate driver integrated circuits 152.

The apparatus for driving an image display device according to the embodiment of the present invention further includes a printed circuit board 120 provided with the timing controller 130 and a power circuit (not shown), a plurality of tape carrier packages (TCPs) 141 provided with the data driver integrated circuits 142 attached between the printed circuit board 120 and the display panel 110, and a plurality of gate TCPs 151 provided with the gate driver integrated circuits 152 attached to the display panel 110.

The image display unit 112 displays images by controlling light transmittance of liquid crystal (LC) cells formed in a matrix arrangement. Each of the liquid crystal cells includes a thin film transistor serving as a switching element connected to a crossing point where gate lines GL cross data lines DL. The data lines DL are supplied with the analog image signals from the respective data driver integrated circuits 142.

Each of the data TCPs 141 is attached between the printed circuit board 120 and the display panel 110 by a tape automated bonding (TAB) method. At this time, input pads of the respective data TCPs 141 are electrically connected to the printed circuit board 120 and their output pads are electrically connected to a data pad of the display panel 110. The data driver integrated circuits 142 are provided on the respective data TCPs 141.

The respective gate TCPs 141 are electrically connected to a gate pad of the display panel 110 by the TAB method. The gate driver integrated circuits 152 are provided on the respective gate TCPs 141.

The printed circuit board 120 is provided with a reference gamma voltage generator (not shown) that supplies reference gamma voltages to the timing controller 130, a power circuit (not shown) and the respective data driver integrated circuits 142. Also, the printed circuit board 120 is provided with signal lines electrically connected between the respective elements.

The timing controller 130 generates data control signals DCS and gate control signals GCS using a main clock DCLK, a data enable signal DE, and horizontal and vertical signals Hsync and Vsync, which are externally input through a user connector, so as to control each driving timing of the data driver integrated circuits 142 and the gate driver integrated circuits 152.

Figure 4:
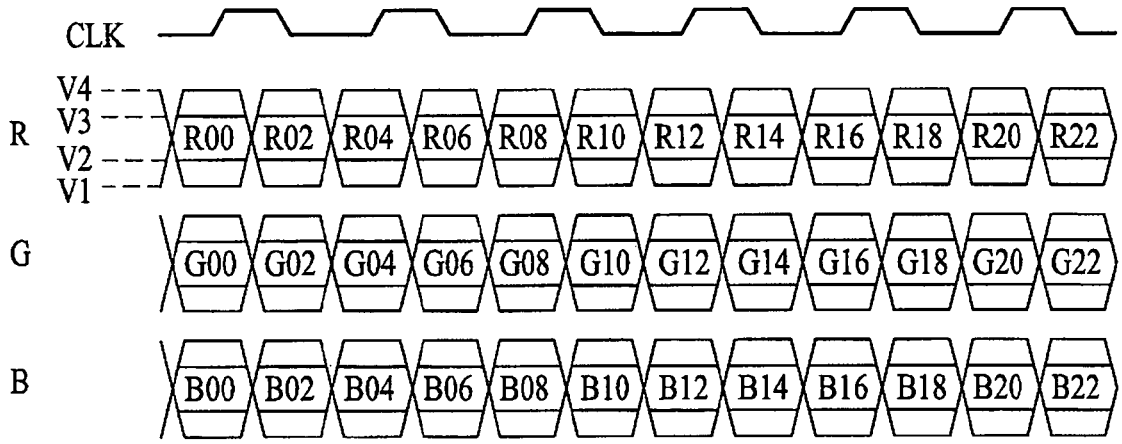
FIG. 4 illustrates waveforms of data signals output from a timing controller shown in FIG. 3.

Also, the timing controller 130 compresses the i bit digital source data (RGB) for the unit of at least 2 bits to convert the compressed data to a plurality of voltage levels and supplies the converted voltage levels to the respective data driver integrated circuits 142 through one data transmission line. In other words, as shown in FIG. 4, the timing controller 130 aligns the i bit digital source data (RGB) externally supplied through the user connector and arranged on the printed circuit board 120 to be suitable for driving of the display panel 110 and converts the aligned data signals to a plurality of voltage levels V1 to V4 depending on clock signals CLK to supply the converted voltage levels to the respective data driver integrated circuits 142.

Figure 5:
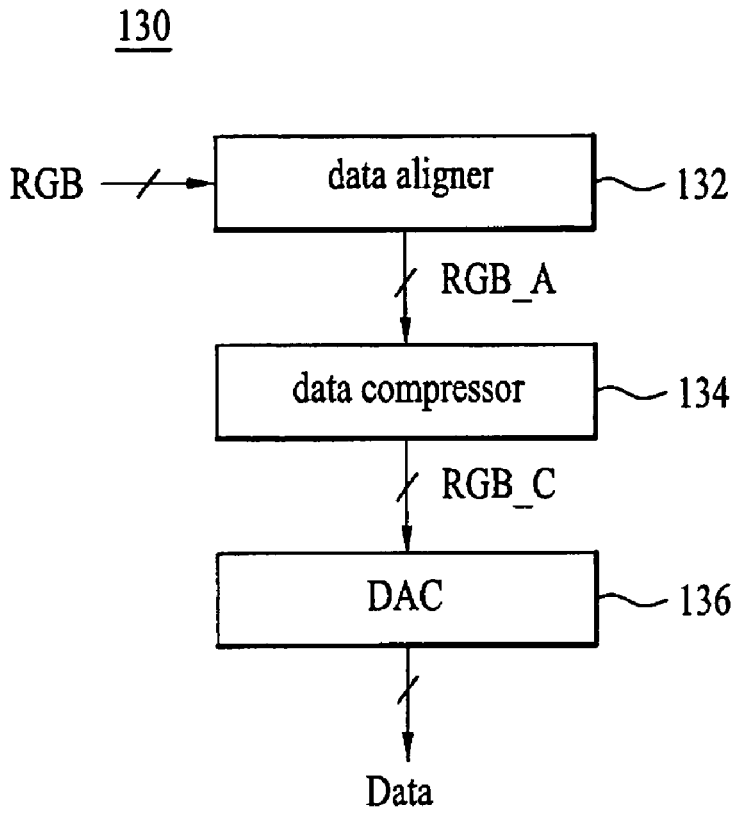
FIG. 5 is a block diagram illustrating a timing controller shown in FIG. 3.

To this end, the timing controller 130, as shown in FIG. 5, includes a data aligner 132 aligning the external i bit digital source data (RGB), a data compressor 134 compressing the aligned data RGB_A for the unit of at least 2 bits, and a digital-to-analog converter (DAC) 136 converting the compressed data RGB_C to a plurality of voltage levels and transmitting them to the respective data driver integrated circuits 142.

The data aligner 132 aligns the external i bit digital source data (RGB) to correspond to resolution of the display panel 110 and supplies the aligned data to the data compressor 134.

The data compressor 134 compresses the aligned data RGB_A supplied from the data aligner 132 for the unit of at least 2 bits and supplies the compressed data to the DAC 136. It is supposed that the data compressor 134 compresses the aligned data RGB_A for the unit of 2 bits. Therefore, the data compressor 134 compresses first bits R0, G0 and B0 and second bits R1, G1 and B1, third bits R2, G2 and B2 and fourth bits R3, G3 and B3, fifth bits R4, G4 and B4 and sixth bits R5, G5 and B5, and seventh bits R6, G6 and B6 and eighth bits R7, G7 and B7, if the aligned data RGB_A are 8 bits. In other words, the data compressor 134 generates compressed data RGB_C by adding n+1 bit to n bit in the aligned data RGB_A as shown in Table 1.

TABLE 1

| n + 1 bit | N bit | Compressed data (RGB_C) |
|---|---|---|
| 0 | 0 | 00 |
| 0 | 1 | 01 |
| 1 | 0 | 10 |
| 1 | 1 | 11 |

The DAC 136 converts the compressed data RGB_C compressed for the unit of 2 bits and supplied from the data compressor 134 to the first to fourth voltage levels V1 to V4 as shown in Table 2.

TABLE 2

| Compressed data (RGB_C) | Voltage level |
|---|---|
| 00 | V1 |
| 01 | V2 |
| 10 | V3 |
| 11 | V4 |

In Table 2, the first voltage level V1 has a zero voltage value, and the fourth voltage level V4 has a voltage value of 1~1.5 for low voltage transmission of the data signals. The first to third voltage levels have a voltage value obtained by dividing the value of the fourth voltage level into three parts.

Figure 6:
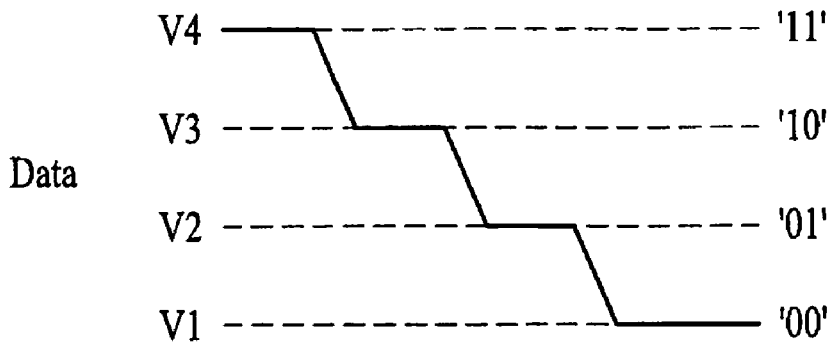
FIG. 6 illustrates a plurality of voltage levels converted by a digital-to-analog converter (DAC) shown in FIG. 5.

The DAC 136, as shown in FIG. 6, converts the compressed data RGB_C supplied from the data compressor 134 to data signals having any one of the first to fourth voltage levels V1 to V4 in a digital-to-analog mode so as to output them.

Figure 7:
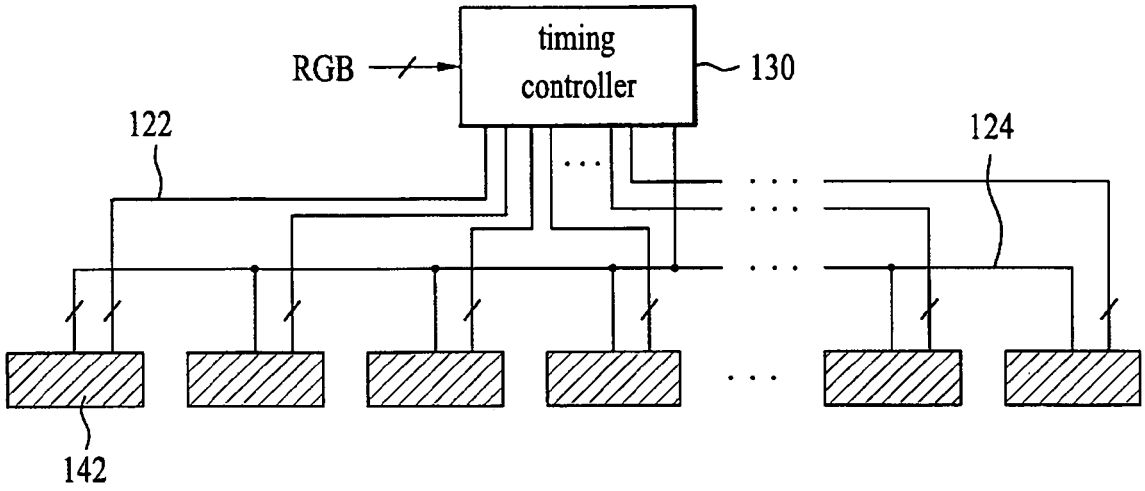
FIG. 7 illustrates a connection structure between a timing controller and a plurality of data driver integrated circuits shown in FIG. 3.

The aforementioned timing controller 130, as shown in FIG. 7, transmits the data signals of red (R), green (G), and blue (B) converted to the voltage levels V1 to V4 through three data transmission lines 122 to the data driver integrated circuits 142 of the data driver 140. Also, the timing controller 130 transmits the data control signals DCS in the control signal transmission lines 124 to the data driver integrated circuits 142 in common.

Figure 8:
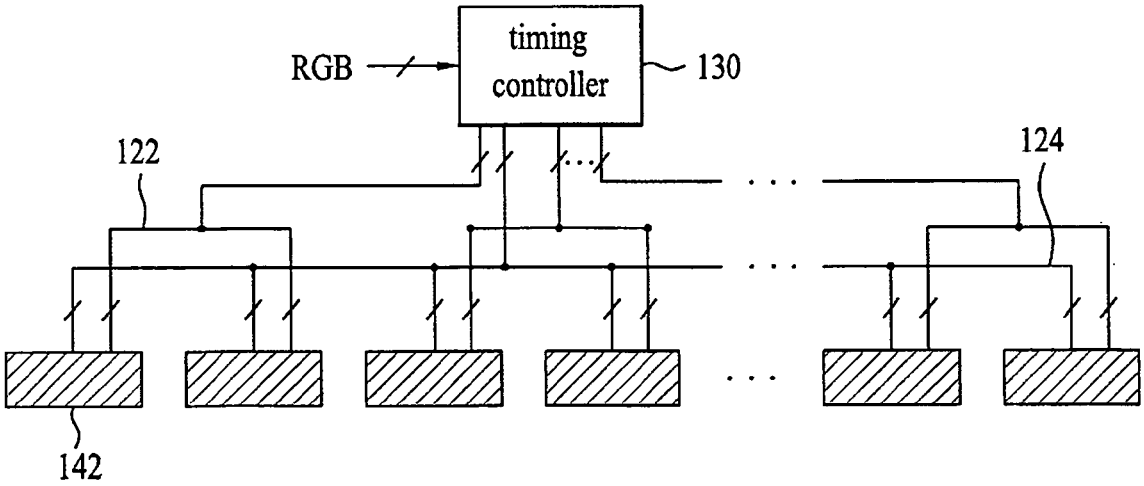
FIG. 8 illustrates another connection structure between a timing controller and a plurality of data driver integrated circuits shown in FIG. 3.

Meanwhile, the timing controller 130, as shown in FIG. 8, can transmit the data signals of red (R), green (G), and blue (B) converted to the voltage levels V1 to V4 through the three data transmission lines 122 to the data driver integrated circuits 142 in pairs. Also, the timing controller 130 transmits the data control signals in the control signal transmission lines 124 to the data driver integrated circuits 142 in common.

Each of the gate driver integrated circuits 152 includes a shift register that sequentially generates scan pulses, i.e., gate high pulses in response to the gate control signal GCS from the timing controller 130. To this end, the gate driver integrated circuits 152 are sequentially driven in response to the gate control signal GCS to sequentially supply the scan pulses to the gate lines of the display panel 110.

Each of the data driver integrated circuits 142 restores the data signals of the multilevel supplied from the DAC 136 of the timing controller 130 to the original i bit digital data signals (RGB) and converts the restored i bit digital data signals (RGB) to the analog image signals to supply them the respective data lines DL.

Figure 9:
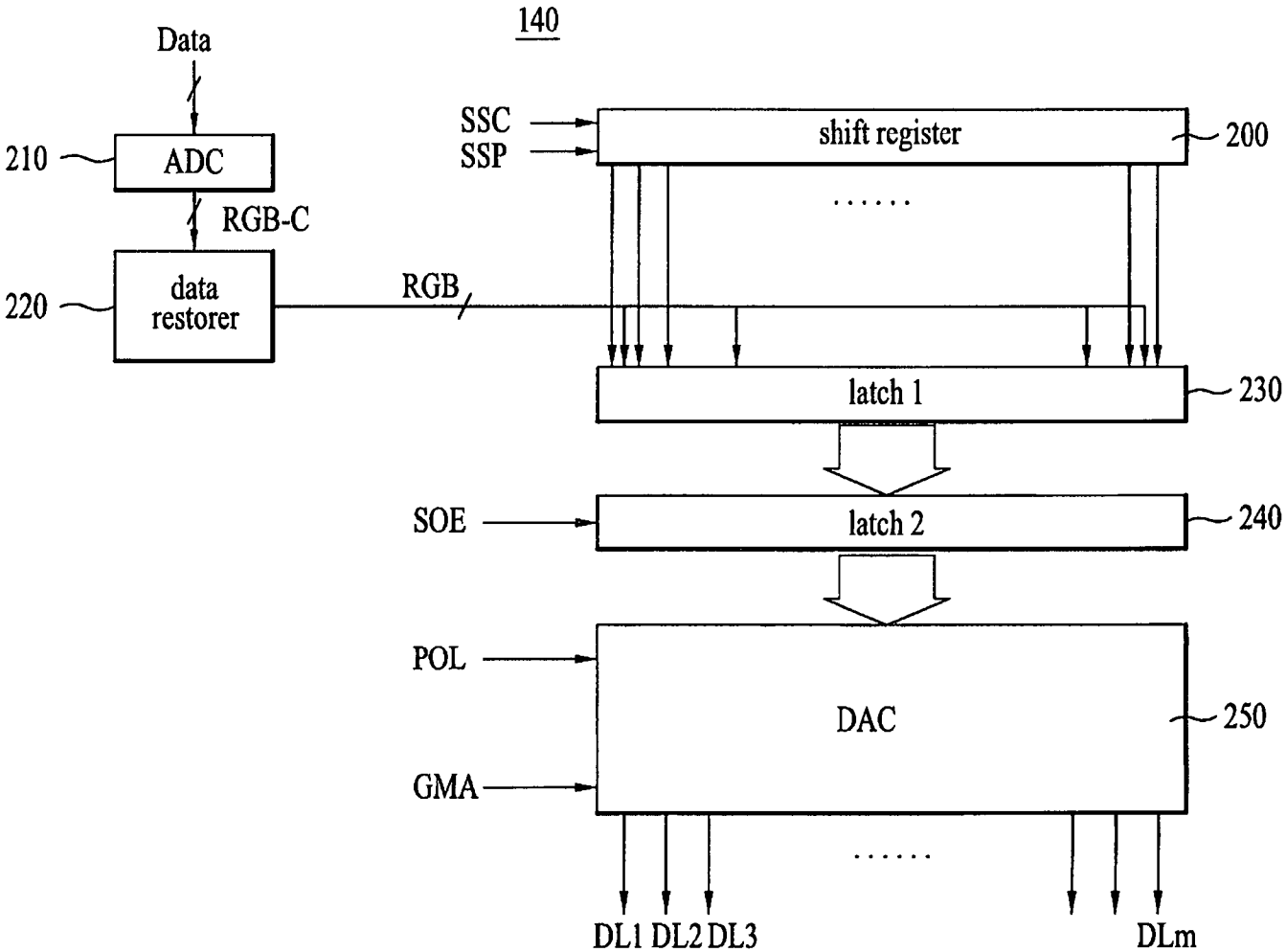
FIG. 9 is a block diagram illustrating each data driver integrated circuit shown in FIG. 3.

To this end, each of the data driver integrated circuits 142, as shown in FIG. 9, includes an analog-to-digital converter (ADC) 210 converting the data signals of the multilevel supplied from the timing controller 130 to digital data signals RGB_C compressed for the unit of 2 bits in an analog-to-digital mode, a data restorer 220 restoring the data signals RGB_C compressed from the ADC 210 to i bit digital data signals RGB, a shift register 200 generating sampling signals using a source shift clock SSC and a source start pulse SSP among the data control signals DCS from the timing controller 130, a first latch 230 sequentially sampling the data signals RGB corresponding to one line supplied from the data restorer 220 depending on the sampling signals, a second latch 370 simultaneously outputting the data signals sampled by the first latch 230 and corresponding to one line depending on a source output enable (SOE) signals among the data control signals DCS, and a DAC 250 converting the data signals corresponding to one line supplied from the second latch 370 to analog image signals to supply the converted signals to the respective data lines DL of the display panel 110.

The ADC 210 converts the data signals of the multilevel supplied from the timing controller 130 in an analog-to-digital mode to generate the compressed data RGB_C for the unit of 2 bits as shown in Table 3 depending on the voltage levels of the data signals of the multilevel.

TABLE 3

| Voltage level | Compressed data (RGB_C) |
|---|---|
| V1 | 00 |
| V2 | 01 |
| V3 | 10 |
| V4 | 11 |

The ADC 210 generates the compressed data RGB_C of '00' if the voltage value of the data signals is the first voltage level V1, the compressed data RGB_C of '01' if the voltage value of the data signals is the second voltage level V2, the compressed data RGB_C of '10' if the voltage value of the data signals is the third voltage level V3, and the compressed data RGB_C of '11' if the voltage value of the data signals the fourth voltage level V4.

The data restorer 220 splits the compressed data for the unit of 2 bits converted from the ADC 210 into n bit and n+1 bit shown in Table 4 to restore the i bit digital data RGB.

TABLE 4

| Compressed data (RGB_C) | n + 1 bit | n bit |
|---|---|---|
| 00 | 0 | 0 |
| 01 | 0 | 1 |
| 10 | 1 | 0 |
| 11 | 1 | 1 |

The shift register 200 shifts the source start pulse SSP depending on the source shift clock SSC to generate the sampling signals and sequentially supplies the sampling signals to the first latch 230.

The first latch 230 sequentially samples the data signals RGB corresponding to one line supplied from the data restorer 220 depending on the sampling signals sequentially supplied from the shift register 200 and supplies the sampled signals to the second latch 240.

The second latch 240 stores the digital data RGB sampled by the first latch 230 for the unit of one line and outputs the digital data RGB for the unit of one line to the DAC 250 by synchronizing the digital data RGB for the unit of one line with the source output enable SOE signal.

The DAC 250 converts the digital data RGB supplied from the second latch 240 to the analog image signals using a plurality of input gamma voltages GMA and supplies the converted signals to the respective data lines DL of the display panel 110. At this time, the DAC 250 converts the digital data RGB to analog image signals of positive polarity (+) or negative polarity (−) depending on a polarity control signal (POL) among the data control signals DCS from the timing controller 130.

In the aforementioned apparatus and method for driving an image display device according to the embodiment of the present invention, the external i bit digital source data RGB are compressed for the unit of 2 bits and converted in a multilevel so that the data for the unit of 2 bits are transmitted to the data driver integrated circuits 142 through one data transmission line.

Therefore, since the data of at least 2 bits are transmitted in four voltage levels, transmission frequencies of the data can be reduced as less as four times. This reduces EMI and the size of the printed circuit board 120.

Meanwhile, the present invention may be used for display devices including a plasma display panel and a light-emitting display device in addition to the aforementioned LCD that displays images by controlling light transmittance of the liquid crystal.

As described above, the apparatus and method for driving an image display device according to the present invention has the following advantages.

The digital data of at least 2 bits are converted in a plurality of voltage levels so that the digital data of at least 2 bits are transmitted to the data driver integrated circuits through one data transmission line. Therefore, it is possible to reduce transmission frequencies of the data, the number of the data transmission lines, EMI, and the size of the printed circuit board.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving an image display device comprising:

a display panel including an image display unit for displaying images, a plurality of data driver integrated circuits supplying image signals to the image display unit; and a timing controller converting externally supplied i bit digital source data (i is a positive number) to a plurality of voltage levels to supply the converted voltage levels to the respective data driver integrated circuits and controlling the data driver integrated circuits, wherein the timing controller compresses the i bit digital source data for the unit of at least 2 bits and converts the compressed data to the plurality of voltage levels to supply the converted voltage levels to the data driver integrated circuits, wherein each of the data driver integrated circuits includes:

an analog-to-digital converter converting the voltage levels to the digital data for the unit of at least 2 bits;

a data restorer restoring the digital data for the unit of at least 2 bits from the analog-to-digital converter to i bit digital data signals;

a shift register generating sampling signals;

a latch latching the digital data signals from the data restorer depending on the sampling signals; and a digital-to-analog converter converting the digital data signals from the latch to the image signals to supply the converted signals to the display panel.

2. The apparatus as claimed in claim 1, wherein the timing controller includes a data compressor compressing the i bit digital source data for the unit of at least 2 bits, and a digital-to-analog converter converting the compressed data from the data compressor to the plurality of voltage levels and supplying them to the data driver integrated circuits.

3. The apparatus as claimed in claim 2, wherein the digital-to-analog converter converts the compressed data to any one of the first to fourth voltage levels.

4. The apparatus as claimed in claim 3, wherein the first to third voltage levels are obtained by dividing the fourth voltage level into three parts.

5. The apparatus as claimed in claim 1, wherein the timing controller supplies the plurality of voltage levels to the respective data driver integrated circuits.

6. The apparatus as claimed in claim 1, wherein the timing controller supplies the plurality of voltage levels to the data driver integrated circuits in pairs.

7. A method for driving an image display device including an image display unit for displaying images, the method comprising:

converting externally supplied i bit digital source data (i is a positive number) to a plurality of voltage levels, wherein the step of converting the i bit digital source data to the voltage levels includes compressing the i bit digital source data for the unit of at least 2 bits, and converting the compressed data to the plurality of voltage levels;

restoring the voltage levels to i bit digital data to convert them to image signals; and simultaneously supplying scan pulses and the image signals to the image display unit to display the images, wherein the step of restoring the voltage levels to i bit digital data to convert them to the image signals includes:

converting the voltage levels to the digital data for the unit of at least 2 bits;

restoring the digital data for the unit of at least 2 bits to i bit digital data to generate data signals;

generating sampling signals;

latching the data signals depending on the sampling signals; and converting the latched data signals to the image signals in a digital-to-analog mode to supply the converted signals to the image display unit.

8. The method as claimed in claim 7, wherein the step of converting the compressed data to the voltage levels includes converting the compressed data to any one of the first to fourth voltage levels.

9. The method as claimed in claim 8, wherein the first to third voltage levels are obtained by dividing the fourth voltage level into three parts.

* * * * *

UNITED STATES PATENT AND TRADEMARK OFFICE

CERTIFICATE OF CORRECTION

PATENT NO. : 7,629,956 B2
APPLICATION NO. : 11/301948
DATED : December 8, 2009
INVENTOR(S) : Jang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1029 days.

Signed and Sealed this

Second Day of November, 2010

David J. Kappos

David J. Kappos
*Director of the United States Patent and Trademark Office*